United States Patent [19]

Katayama et al.

[11] 3,999,852

[45] Dec. 28, 1976

[54] COPYING APPARATUS CAPABLE OF BOTH-SIDE PRINTING

[75] Inventors: Hajime Katayama; Tateki Nagaoka; Koichi Miyamoto, all of Tokyo, Japan

[73] Assignee: Canon Kabushiki Kaisha, Tokyo, Japan

[22] Filed: Oct. 17, 1975

[21] Appl. No.: 623,309

Related U.S. Application Data

[63] Continuation of Ser. No. 432,356, Jan. 10, 1974, abandoned.

[30] Foreign Application Priority Data

Jan. 17, 1973 Japan ..... 48-7673

[52] U.S. Cl. ..... 355/26; 101/91; 101/113; 101/470; 271/DIG. 9; 355/24; 198/400

[51] Int. Cl.[2] ..... G03G 15/00

[58] Field of Search ..... 355/23, 24, 26; 271/DIG. 9; 101/91, 113, 132, 468, 230–233, 470; 209/72, 74 M, DIG. 1; 198/262, 268–272

[56] References Cited

UNITED STATES PATENTS

| | | | |
|---|---|---|---|
| 3,227,444 | 1/1966 | Egan | 355/23 |
| 3,615,129 | 10/1971 | Drawe et al. | 355/26 |
| 3,645,615 | 2/1972 | Spear, Jr. | 271/9 |
| 3,672,765 | 6/1972 | Altmann | 271/DIG. 9 |
| 3,856,295 | 12/1974 | Looney | 355/24 |

FOREIGN PATENTS OR APPLICATIONS

| | | | |
|---|---|---|---|
| 147,677 | 11/1936 | Austria | 271/DIG. 9 |

*Primary Examiner*—Edgar S. Burr
*Assistant Examiner*—William Pieprz
*Attorney, Agent, or Firm*—Fitzpatrick, Cella, Harper & Scinto

[57] ABSTRACT

A copying apparatus capable of both-side printing comprises automatic feed means, copy medium transport means, change-over guide means shiftable between a first position for one-side printing and a second position for both-side printing, and copy medium stop means for stopping and holding the copy medium at a predetermined position when it has been directed to the automatic feed means by the change-over guide means in its second position.

5 Claims, 5 Drawing Figures

COPYING APPARATUS CAPABLE OF BOTH-SIDE PRINTING

This is a continuation, of applicaton Ser. No. 432,356 filed Jan. 10, 1974 now abandoned.

BACKGROUND OF THE INVENTION

1. Field of the Invention

This invention relates to a copying apparatus which is capable of selectively effecting one-side printing and both-side printing, as required.

2. Description of the Prior Art

Copying machines of the prior art have generally been of the single-side printing type which are capable of printing only one side of copy medium. According to such prior art systems, the quantity of copies produced is double the quantity of copies which would be produced by a both-side printing system, and where huge quantities of copies are to be stored, this has been disadvantageous in terms of storage space, weight and cost.

Some types of image transfer copiers capable of both-side printing have heretofore been conceivable. A first one of them is the type which uses two photosensitive drums to form thereon discrete images which are to be transferred to the opposite sides of a copy medium. This is simple in principle but requires two sets of copying process elements which in turn leads to a higher cost and larger scale of the apparatus. A second type uses a single photosensitive drum and a mediate drum in such a manner that an image to be transferred to one side of a copy medium is first formed on the photosensitive drum and transferred to the mediate drum for temporary preservation thereon, whereafter an image to be transferred to the other side of the copy medium is formed again on the photosensitive drum, and then the two images are transferred from the mediate drum and the photosensitive drum to the opposite sides of the copy medium, respectively. This second type involves only one set of copying process elements but requires the image transfer to be effected twice through the agency of the mediate drum, thus resulting in a reduced image transfer efficiency and other disadvantages.

SUMMARY OF THE INVENTION

It is therefore an object of the present invention to overcome all the above-noted disadvantages and provide a most practical copying apparatus which is capable of both-side printing.

Another object of the present invention is to provide a compact copying apparatus which is capable of both-side printing.

Still another object of the present invention is to provide a less expensive copying apparatus which is capable of both-side printing.

Yet another object of the present invention is to provide a copying apparatus which is capable of both-side printing with higher image transfer efficiency.

A further object of the present invention is to provide a copying machine which can be selectively used for one-side printing and both-side printing, as required.

A further object of the present invention is to provide a copying apparatus which can be simply changed over between one-side printing mode and both-side printing mode.

A further object of the present invention is to provide a copying apparatus which can also meet the requirement for mass production of copies.

A further object of the present invention is to provide a copying apparatus which is capable of both-side printing and also permits manual paper feed to be readily effected.

According to the present invention, ordinary one-side printing is first effected on one side of a copy medium and thereafter, the one-side printed copy medium is again directed to the original feed means or to a second feed means, from which the copy medium is re-fed in up-side-down condition into the copying apparatus for ordinary one-side printing to be effected on the other side of the copy medium. The previously described first and second systems have led to a higher cost, larger scale or reduced image transfer efficiency of the apparatus as noted above, whereas the present invention requires only one set of copying process elements as in the ordinary one-side printing system and thus, provides a low-cost, compact and most practical copying apparatus capable of both-side printing. Thus, the present invention overcomes the disadvantages peculiar to the single-side printing system in terms of the storage space for copies, weight, cost, etc. and at the same time, eliminates the drawbacks such as high cost, large scale and/or reduced image transfer efficiency peculiar to the both-side printing system.

In addition, the present invention enables one-side printing and both-side printing to be selected as required, simply by depression of a change-over switch or both-side print switch and this ensures mass production of copies to be carried out highly efficiently.

Furthermore, the present invention permits any different size or type of copy medium to be manually inserted into the apparatus along an upper guide forming part of a copy tray, if such copy medium is desired during copying.

The invention will become more fully apparent from the following detailed description thereof taken in conjunction with the accompanying drawings.

DESCRIPTION OF THE PREFERRED EMBODIMENTS

An embodiment of the copying apparatus to which the present invention is applied will first be described.

Figure 1:
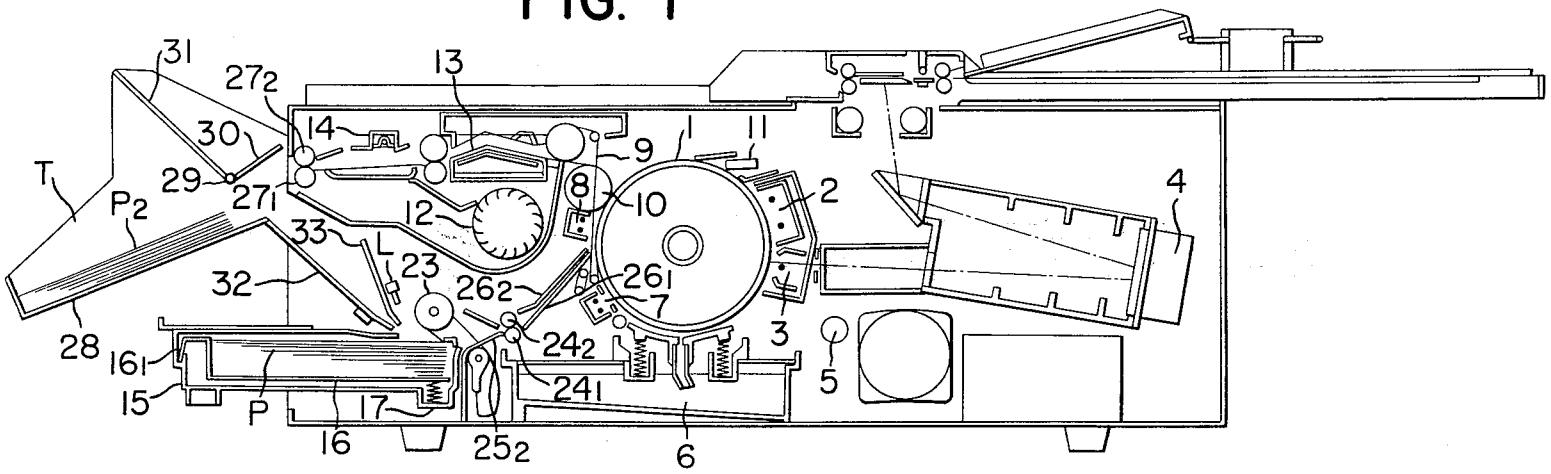
FIG. 1 is a sectional view of the copying apparatus of the present invention with the passage to the copy storage portion of the copy tray being opened.

In FIG. 1, a photosensitive drum 1 is subjected to primary charge by a primary charger 2 and then to secondary charge of the opposite polarity or AC discharge by a secondary charger 3 simultaneously with application of image light thereto, whereafter it is subjected to overall exposure by a lamp 5 to thereby form a latent image on the surface of the drum 1. The latent image is developed into a visible image by a developing device 6, whereafter any developing liquid remaining on the drum surface is squeezed by a squeeze charger 7, and then at a copy charger 8, the developed image is transferred to a sheet of transfer paper P which has been guided there by guides $26_1$ and $26_2$. The photosensitive drum 1 is further rotated to have the residual image thereon cleared away by a blade cleaner 11. The copy paper sheet P, now bearing the transferred image thereon, is separated from the surface of the photosensitive drum by a separator roller 10 and a suction blower 12, and directed onto a heating-fixing plate 13 to have the image fixed thereby, whereafter the printed paper sheet P is deelectrified by a discharger 14 and discharged into a copy collecting assembly including a tray T, and guide elements 30, 31, 32 and 33.

Figure 2:
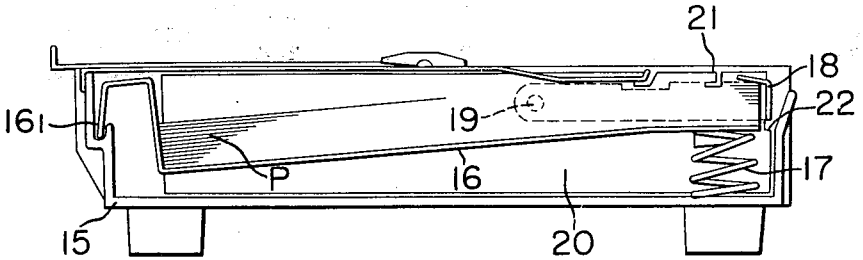
FIG. 2 is a sectional view of the feed means.

In the present embodiment, feed means is of the cassette type. More specifically, as is shown in FIG. 2, a supply of copy paper sheets P is held in a cassette 15 which is detachably mounted in the feed station of the apparatus. An intermediate plate 16, supporting thereon a pile of copy paper sheets P, has a rear end $16_1$ as the fulcrum and a fore end portion biased upwardly by a spring 17. By suitably selecting the spring constant of the spring 17, the force with which the uppermost one of the copy paper sheets P is raised up may be made constant irrespective of the quantity of the copy paper P in the cassette 15. A separator pawl 18 for separating the copy paper sheets one after another and feeding them successively from the cassette rests on the uppermost one of the copy paper sheets P and is supported for movement between stops 21 and 22 provided on a side plate 20. The separator pawl 18 is normally urged upwardly into engagement with the upper stop 21 by the spring 17 through the intermediate plate 16 and the stock of copy paper P. In response to a feed signal, a normally rotating roller 23 is lowered into a feeding position to engage the uppermost one of the copy paper sheets P in the cassette 15 and depress the paper stock by a predetermined amount. Incident thereto, the separator pawl 18 is also depressed due to gravity. With the aid of the rotation of the feed roller 23 and the action of the separator pawl 18, the uppermost one of the copy paper sheets P is separated from the underlying paper stock and fed toward the image transfer station. However, timing rollers $24_1$ and $24_2$, constituting transport means for the copy paper, are disposed closely adjacent to the feed station are stopped from rotating immediately after the lowering of the feed roller 23, and thus, the copy paper sheet P fed from the cassette 15 forms a slack between paper guides $25_1$ and $25_2$ with the leading edge of the paper sheet striking against the nip of the timing rollers $24_1$ and $24_2$. Immediately thereafter, in response to a paper feed start signal, the timing rollers $24_1$ and $24_2$ begin to rotate, thus permitting the copy paper sheet P to be transported at a speed equal to the peripheral speed of the photosensitive, thus permitting synchronous registration between the copy sheet and a developed image on the drum. In the meantime, the feed roller is again lifted out of engagement with the paper stock in a predetermined time after it was lowered. Thus, the subsequent transport of the fed paper sheet P is accomplished by the timing rollers $24_1$, $24_2$ and subsequent paper transport means. During the ordinary one-side printing, the transfer paper sheets P are successively discharged out of the apparatus by the dicharge rollers $27_1$ and $27_2$ are collected in the copy storage portion 28 of the copy tray T.

Figure 3:
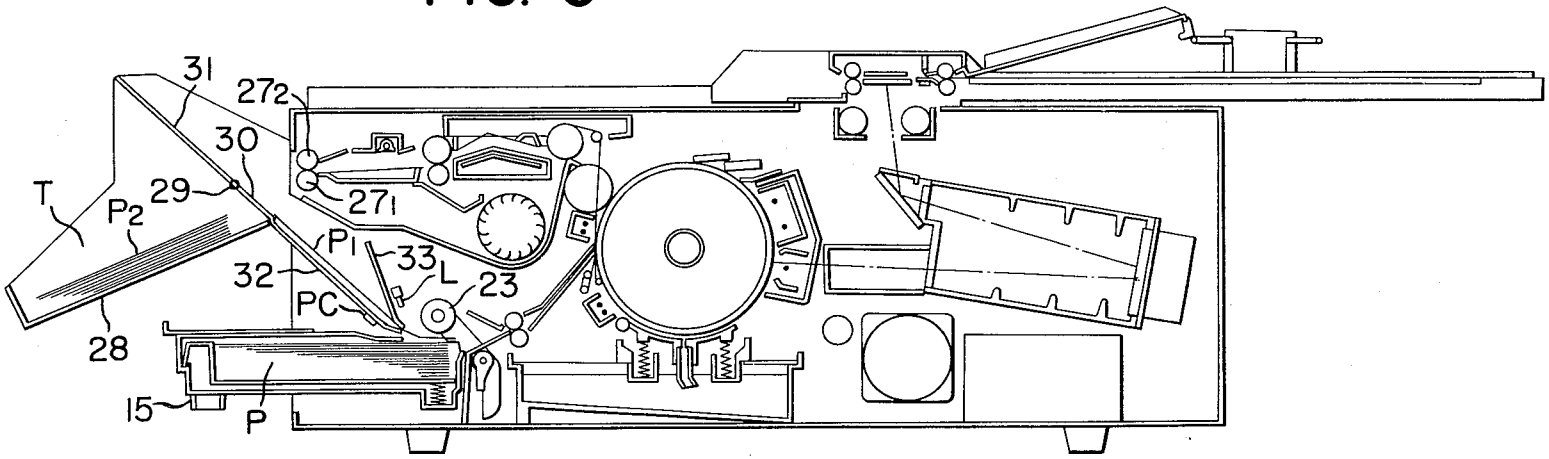
FIG. 3 is a sectional view of the same copying apparatus with the passage to the copy storage portion being closed.
Figure 4:
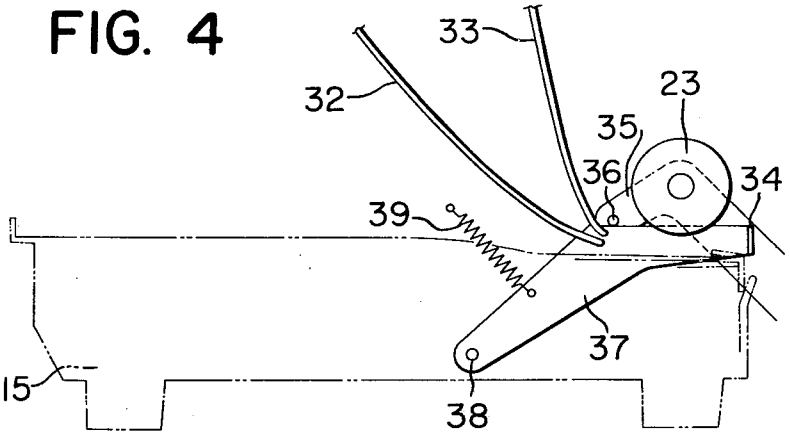
FIG. 4 schematically illustrates the operating mechanism for feed roller and copy medium stop.

Both-side printing as accomplished by the present invention will now be described. When both-side printing is desired, a change-over guide 30 such as a plate pivotable about a pivot 29 provided in the copy tray T is first rotated clockwise to assume a position as shown in FIG. 3, where the guide 30 blocks the passage to the copy storage portion 28. Thereafter, printing on the other side of the copy paper sheets may take place in the same way as the ordinary one-side printing. A copy paper sheet P1, having one-side thereof already printed is discharged through the discharge rollers $27_1$ and $27_2$, but the leading edge thereof is blocked by the change-over guide 30 and directed upwardly along such guide and along a fixed guide 31 forming an upper extension of the guide 30. When the trailing edge of the copy paper sheet P1 leaves the discharge rollers $27_1$. $27_2$ and becomes free from the transport force imparted by these rollers, the transfer paper sheet P1 slides downwardly due to gravity, toward and along a fixed lower guide 32 and an auxiliary guide 33, with the trailing edge now as the leading edge. Thus, the one-side printed copy paper sheet P1 is again directed by the lower and auxiliary guides 32 and 33 onto the stock of the copy paper P in the cassette 15, and it advances below the feed roller 23 in up-side-down condition and comes to a halt striking against a copy paper stop 34 provided near the separator pawl 18, as shown in FIG. 4.

Thereafter, the change-over guide 30 may be rotated counter-clockwise to restore its original position, and then the second one-side printing may be effected on the copy paper sheet P1 in the ordinary manner, thus accomplishing both-side printing. More specifically, when the feed roller 23 is lowered to effect paper feed, a pin 36 provided at the end of an arm 35 supporting the feed roller 23 depresses an arm 37 supporting the stop 34, so that the stop 34 is rotated about a pivot 38 to escape from the feed path for the copy paper sheet P1. The feed roller 23 is further lowered into engagement with the one-side printed paper sheet P1, and depresses it with the underlying paper stock P, thus feeding the paper sheet P1. The underlying paper sheets P are never fed out since little or no feeding force is then imparted thereto, though they are depressed. At the time of paper feed, the leading edge of the one-side printed paper sheet P1 is not always aligned with the leading edge of the underlying paper stock P, but no error occurs with respect to the positional relation between the image to be transferred and the one-side printed paper sheet P1 because timed movement of the paper sheet P1 is thereafter provided by the timing rollers for synchronization with the photosensitive drum. Also, incident to the upward movement of the feed roller 23, the transfer paper stop 34 is returned to its original position by the force of the spring 39. Thereafter, image transfer is effected on the paper sheet P1 in the image transfer station 8 to complete both-side printing, and then the paper sheet P1 is discharged as paper sheet P2 through the discharge rollers $27_1$ and $27_2$ and directed by the change-over guide 30 for collection in the copy storage portion 28 of the copy tray.

Figure 5:
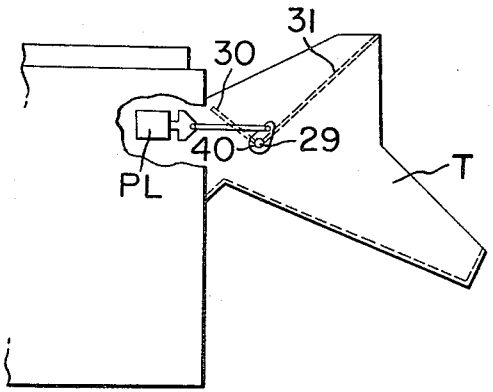
FIG. 5 schematically illustrates the operating mechanism for plunger and change-over guide.

To enhance the efficiency of copying, the change-over guide 30 may be automatically positioned when both-side printing is desired. As is shown in FIG. 5, an arm 40 is secured to one end of the pivot shaft 29 of the change-over guide 30. The arm 40 may be attracted by a plunger PL to rotate the change-over guide 30 about the pivot 29 so as to block the passage of the transfer paper to the copy storage portion 28. Such passage of the transfer paper to the copy storage portion 28 is normally opened by the action of a spring.

Figure 6:
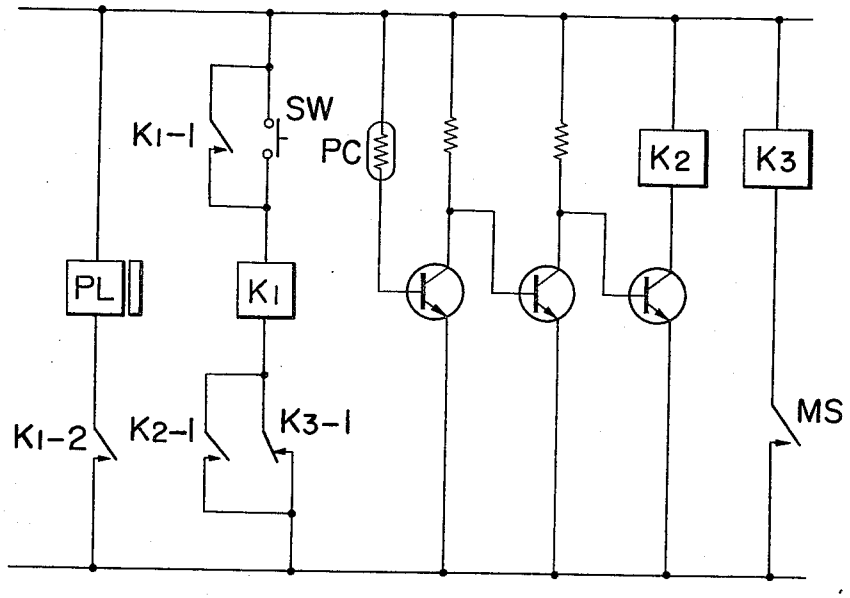
FIG. 6 is a diagram of the electric circuit for operating the plunger-operated change-over guide.

FIG. 6 diagrammatically shows an electric circuit, which, together with a lamp L, constitutes a system for detecting the presence of a copy sheet between the guides 32 and 33, and for operating the plunger PL. When both-side printing is to be effected, a both-side print switch SW provided on the operating panel of the copying apparatus may be actuated to energize a relay K1, whose contact K1-1 is thus closed and self-holds while, at the same time, the other contact K1-2 is closed to energize the plunger PL, which in turn rotates the change-over guide 30 to block the passage of the transfer paper to the copy storage portion 28, thus making the apparatus ready for both-side printing. When ordinary one-side printing has been effected, the copy paper sheet P1 subjected to the one-side printing is caused to enter into the space between the lower guide 32 and the auxiliary guide 33 because the passage to the copy storage portion 28 is already blocked. Thereupon, light passing from a lamp L to a detector photocell PC is intercepted to detect the entry of the one-side printed paper sheet P1. Since the resistance of the photocell PC is normally reduced due to the light impinging thereon, a relay K2 is energized, by the action of three transistors, and has its contact K2-1 closed. As is apparent from the schematic, the three transistors, from left to right, have "ON", "OFF", "ON" conductive states, respectively, when the resistance of photocell PC is reduced by the impingement of light; and such conductive states reverse when light is blocked from photocell. Thus, when the resistance of the photocell PC is increased by the one-side printed paper sheet P1 intercepting the light passed from the lamp L to the photocell PC, thus deenergizing the relay K2 is deenergized and its contact K2-1 opened. Subsequently, when the feed roller 23 is lowered to start the printing of the other side, a microswitch MS is actuated to energize a relay K3 which produces a feed signal. When the contact K3-1 of this relay is opened, and the contact K2-1 is also opened to deenergize the relay K1 is deenergized and its contact K1-2 is thus opened to deenergize the plunger PL and return the change-over guide 30 to its original position. Thus, the copy paper sheet P2 having both sides printed is collected in the copy storage portion 28.

We claim:

1. A copying apparatus for forming images on both sides of a copy sheet, comprising;

a single holder means for holding a supply of copy sheets to be fed;

a single pick-up means including a surface for contacting the topmost copy sheet and for feeding the copy sheets one at a time from said holder means;

means for forming images on a copy sheet;

a single feeding means for feeding a copy sheet from said pick-up means to said image forming means;

a tray for receiving copy sheets discharged from said image forming means;

means, including a member movable between first and second positions, to guide copy sheets discharged from said image forming means to said tray when said member is in said first position and to guide copy sheets discharged from said image forming means back to said single holder means to at least partially overlie the topmost copy sheet therein when said member is in said second position;

means for selectively moving said member, whereby when said member is moved to said second position, a copy sheet having an image formed on one side thereof is guided back to said holder means and is again contacted by said surface of said single pick-up means and fed to said image forming means for receiving an image on the other side thereof.

2. A copying apparatus as set forth in claim 1, wherein said printing means includes a photosensitive drum and means for forming a developed image on said drum, and wherein said single feeding means includes timing roller means for moving a copy sheet for synchronous registration with said developed image on said drum.

3. A copying apparatus as set forth in claim 1, wherein said pick-up means surface includes a driven roller mounted for movement between pick-up and non-pick-up positions, movably mounted stop means for blocking movement of a copy sheet slidably received from said guide means, and means for moving said stop means to permit advancement of the copy sheet when said driven roller is moved to said pick-up position.

4. A copying apparatus as set forth in claim 1, further comprising copy sheet detector means for detecting the presence of a copy sheet positioned between said movable member in its second position and said single holder means, and wherein said moving means is responsive to said detection of a copy sheet by said detector means to move said member from said second position to said first position.

5. A copying apparatus for forming images on both sides of a copy sheet, as set forth in claim 1, wherein said means to guide copy sheets discharged from said image forming means further includes;

a guide plate having a first end and a second end, said first end being spaced a finite distance above said second end and said second end being positioned adjacent to said holder means such that the copy sheet slides downwardly along said guide plate to said holder means for movement to said image forming means for forming an image on the other side thereof.

* * * * *